US008863312B1

(12) United States Patent
Gary

(10) Patent No.: US 8,863,312 B1
(45) Date of Patent: Oct. 21, 2014

(54) GLOVE FOR PLAYER USING A GAME SYSTEM

(71) Applicant: Jillian Elease Gary, Alpharetta, GA (US)

(72) Inventor: Jillian Elease Gary, Alpharetta, GA (US)

( * ) Notice: Subject to any disclaimer, the term of this patent is extended or adjusted under 35 U.S.C. 154(b) by 0 days.

(21) Appl. No.: 13/707,071

(22) Filed: Dec. 6, 2012

Related U.S. Application Data

(60) Provisional application No. 61/567,306, filed on Dec. 6, 2011.

(51) Int. Cl.
*A41D 13/00* (2006.01)
*A41D 19/015* (2006.01)

(52) U.S. Cl.
CPC ..... *A41D 19/01523* (2013.01)
USPC ..... 2/20

(58) Field of Classification Search
USPC ..... 2/16, 20, 159, 160, 161.1, 161.2, 161.3, 2/161.4, 161.5, 161.6, 161.8, 162, 163, 2/167
See application file for complete search history.

(56) References Cited

U.S. PATENT DOCUMENTS

| | | | | |
|---|---|---|---|---|
| 5,528,772 | A * | 6/1996 | Cheek | 2/161.1 |
| 6,122,769 | A * | 9/2000 | Wilder et al. | 2/16 |
| 6,618,860 | B1 * | 9/2003 | Sullivan et al. | 2/159 |
| 6,691,315 | B1 * | 2/2004 | Clarke et al. | 2/20 |
| 7,578,006 | B2 * | 8/2009 | Garneau | 2/161.1 |

* cited by examiner

*Primary Examiner* — Tejash Patel
(74) *Attorney, Agent, or Firm* — Baker Donelson Bearman Caldwell & Berkowitz PC

(57) ABSTRACT

A gamer's glove having finger and thumb tubes for the gamer's fingers and thumb to extend outwardly thereof, a palm portion defining at least a central aperture, whereby the glove being worn during grasping operation of a game controller flexes the palm portion causing air to communicate into and out of the glove for controlling perspiration.

18 Claims, 2 Drawing Sheets

GLOVE FOR PLAYER USING A GAME SYSTEM

TECHNICAL FIELD

The present invention relates to gloves. More particularly the present invention relates to gloves worn by a game player for wicking cooling grasp of a game controller by a player during play of game.

BACKGROUND OF THE INVENTION

In recent years, computerized, interactive games such as XBOX, PS3, and WIT, for example, have become popular entertainment devices. The games operate with a microprocessor that executes instructions for displaying scenes and actions on a video display. The games use a variety of hand-held controller devices for providing input instructions by a player to control actions during play of the games. The game controller devices have a variety of forms but have a common feature of selectively-activated buttons, switches, levers, and the like for the selective operation of features and actions during play of the game.

Playing of the game may become intense, particularly as a player plays the game for a long period of time. While a player may suspend operation of a game for providing an opportunity for relaxing, the hand muscles often become cramped and hands sweat. This combination makes it difficult for a player to hold the game controller for operating the game.

While ergonomic attention may have been considered in the design of the controller devices, for example, the relative spacing and positioning of switches, buttons and lever controls and the grip of a player's hand during use of the controller, common controllers are not generally suitable for all sizes of hands.

Accordingly, there is a need in the art for a glove that meets the need for a comfortable, wicking glove to enable players to hold, handle and operate a game controller during game operation over extended periods of time. It is to such that the present invention is directed.

SUMMARY OF THE INVENTION

The present invention meets the need in the art by providing a game glove comprising a hand-receiving envelope with a palm portion and an opposing back portion, an open portion on a wrist side of the envelope for receiving a gamer's hand therethrough and into the envelope, four finger tubes extend from the envelope opposing the wrist side, and a thumb portion extends at an oblique angle from a side portion of the envelop, the finger tubes and thumb tube are open-ended, and extend a respective first distance, whereby a respective finger and thumb of the gamer's hand for being received therethrough such that the finger tubes and thumb tube cover a first portion of the respective fingers and thumb, leaving a respective distal portion free outwardly of a distal end thereof. The palm portion defines a plurality of spaced-apart apertures disposed proximate the finger tubes with surrounding lands. The glove being worn flexes by movement of the player's hand operating the game controller for communicating air through the aperture for assisting in evaporation of perspiration.

In another aspect, the present invention provides a game glove, comprising a hand-receiving envelope with a palm portion and an opposing back portion, a wrist portion extends from a wrist side of the envelope for receiving a gamer's hand through the wrist portion and into the envelope, four finger tubes extend from the envelope opposing the wrist portion, and a thumb portion extends at an oblique angle from a side portion of the envelop, the finger tubes and thumb tube are open-ended, and extend a respective first distance, whereby a respective finger and thumb of the gamer's hand for being received therethrough such that the finger tubes and thumb tube cover substantially all of a first segment of the respective fingers and thumb, leaving a respective distal portion free. The palm portion defines a plurality of arcuately-aligned spaced-apart apertures proximate the finger tubes. A resilient pad attaches to the palm portion proximate a lateral portion from which the thumb tube and the immediately adjacent finger tube extends, whereby the pad cushions the action of the of the player's thumb while operating the game controller. The glove being worn flexes by movement of the player's hand operating the game controller for communicating air through the apertures for assisting in evaporation of perspiration.

Objects, advantages, and features of the invention will become apparent upon a reading of the following detailed description in conjunction with the drawings and the appended claims.

DETAILED DESCRIPTION

Figure 2:
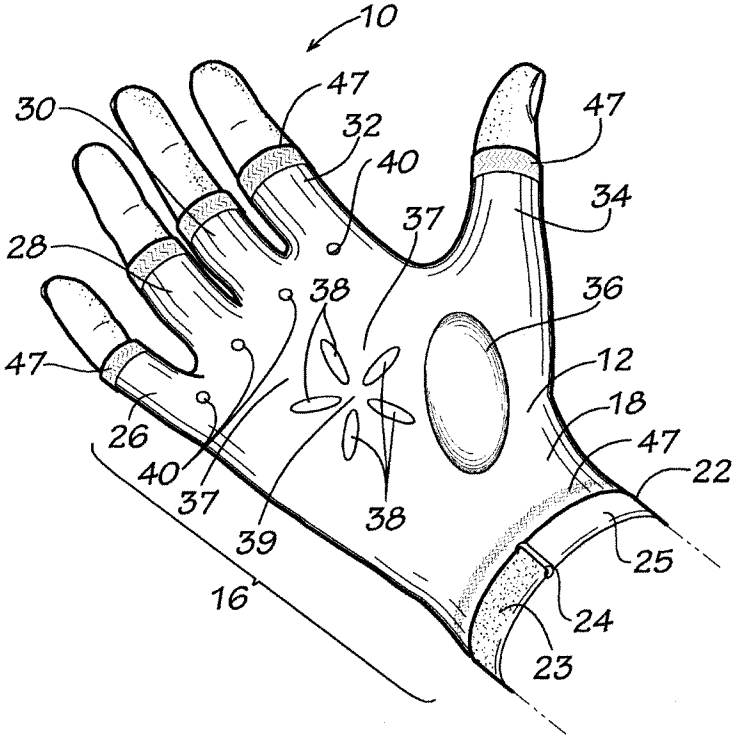
FIG. 2 illustrates a plan view of a palm portion of an alternate embodiment of a game glove in accordance with the present invention.
Figure 1:
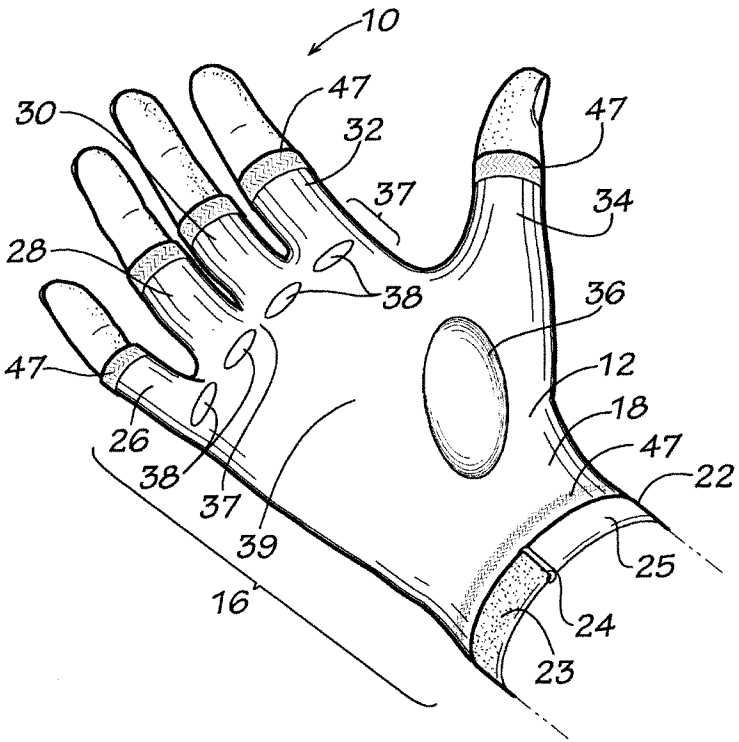
FIG. 1 illustrates a plan view of a palm portion of a game glove in accordance with the present invention.

With reference to the drawings in which like parts have like reference numerals, FIGS. 1 and 2 illustrate in plan view a game glove 10 in accordance with the present invention for use by a person playing video games. The game glove 10 includes a palm portion 12 and a back portion 14 (illustrated in FIG. 3). The palm portion 12 and the back portion 14 cooperatively define an envelope 16 for receiving a hand of a game player through a wrist portion generally 18, 20. A band 22 attaches at on end to a first side of the wrist portion 18. A loop 24 attaches to an opposing side of the wrist portion. A first engaging material 23 attaches to a first portion of the band 22 and a second engaging material 25 attaches to a distal portion of the band. When the band 22 is pulled through the loop 24, the first engaging surface 23 and the second engaging surface 25 detachably engage in order to secure the wrist portions 18, 20 around the wrist of the game player. It is to be appreciated that other closing members or devices may gainfully be used for securing the wrist portion encircling the wrist of the player.

Four finger tubes 26, 28, 30, 32 extend from the envelope 16 opposing the wrist portion 18. A thumb tube 34 extends from the envelope at an oblique angle from a side portion. The finger tubes 26, 28, 30, 32 and the thumb tube 34 are open to the envelope 16 and each tube has a respective open distal end. Each tube 26, 28, 30, 32 and 34 extends a respective first distance. It is contemplated that a respective finger and thumb of the gamer's hand extends through the open wrist portion 18, into the envelope 16, and through a respective one of the finger and thumb tubes. The finger tubes 26, 28, 30, 32 and thumb tube 34 extend the respective first distance sufficiently to cover substantially all of a first segment of the respective finger and thumb extending through the tubes. The respective first distance is selected to be sufficient to cover substantially all of the first segment of the respective finger or thumb to about the first joint. This allows flexible movement of the fingers and thumb for selective operation of the buttons, switches, and levers on the game controller being held and operated by the game player.

A pad 36 attaches in a side portion of the palm portion 12. In the illustrated embodiment, the pad 36 attaches proximate a lateral portion of the envelope 16 from which the thumb tube 34 and the immediately adjacent finger tube 32 extend from the palm portion 12. In the illustrated embodiment, the pad 36 is an elongated, egg-shaped resilient member disposed with a longitudinal axis lateral of a longitudinal axis of the thumb tube 34 and at an oblique angle to a longitudinal axis of the immediately adjacent finger tube. The pad 36 provides a slip-resistant surface to contact the game controller to facilitate holding the game controller.

The palm portion 12 in the illustrated embodiment further defines a plurality of apertures 38 proximate a central portion of the palm portion 12. In the embodiment illustrated in FIG. 1, the palm portion 12 defines the apertures 38 proximate the initial extension of the four finger tubes 32 from the envelope 16. The palm portion 12 thereby has lands 37 about the apertures 38. In the illustrated embodiment, the apertures 38 are oval shaped but may be other shapes, such as circular, rectangular, or irregular.

In the embodiment illustrated in FIG. 2, the palm portion 12 defines the apertures 38 proximate a central portion with adjacent lands 37. The apertures 38 are depicted as oval shaped but may be other shapes, such as circular, rectangular, or irregular. The apertures 38 extend along respective lines radiating from the central point 39.

Further, FIG. 2 illustrates an optional disposed plurality of grip nubs or dots 40 that attach to and extend from the palm portion 12. The grip dots 40 in the illustrated embodiment are disposed proximate the initial extension of the four finger tubes 32 from the envelope 16. The grip dots 40 are made of a non-slip material such as PVC, silicon, rubber, or other resilient material. The grip dots 40 cooperate with the pad 36 for holding the game controller during use for play of a game. It is to be appreciated that the grip dots 40 may be applied optionally to the palm portion 12 for gainful use with the other illustrative embodiments. The grip dots 40 may be dome shaped nubs, oval shaped, elongated lines, or other shape.

Figure 4:
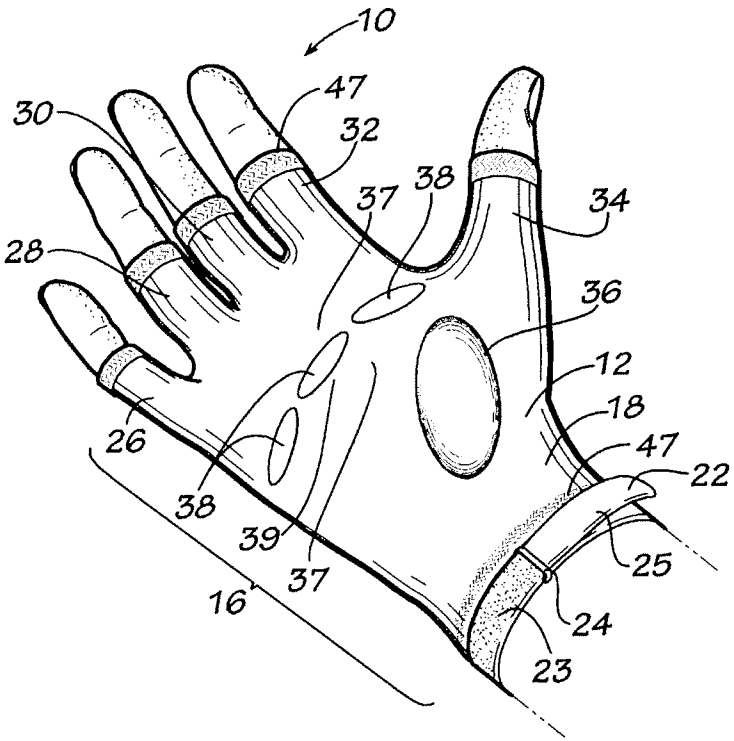
FIG. 4 illustrates a plan view of a palm portion of a game glove in an alternate embodiment.

FIG. 4 illustrates yet another alternate embodiment. The apertures 38 are aligned generally arcuately relative to the substantially central midpoint 39 of the palm portion 12 and are spaced intermediate the initial extension of the four finger tubes 32 from the envelope 16 and a central point 39 of the palm portion.

The apertures 38 in this embodiment extend along an arc line extending from a palm edge aligned with the finger tube 26 to an edge of the envelope 16 between the thumb tube 34 and the finger tube 32. There may be 3 to 5 of the apertures 38, but a number and opening size are sufficient to meet the need for communicating air inwardly of the glove 10 during use as discussed below. An alternate embodiment may have at least one aperture 38.

Figure 3:
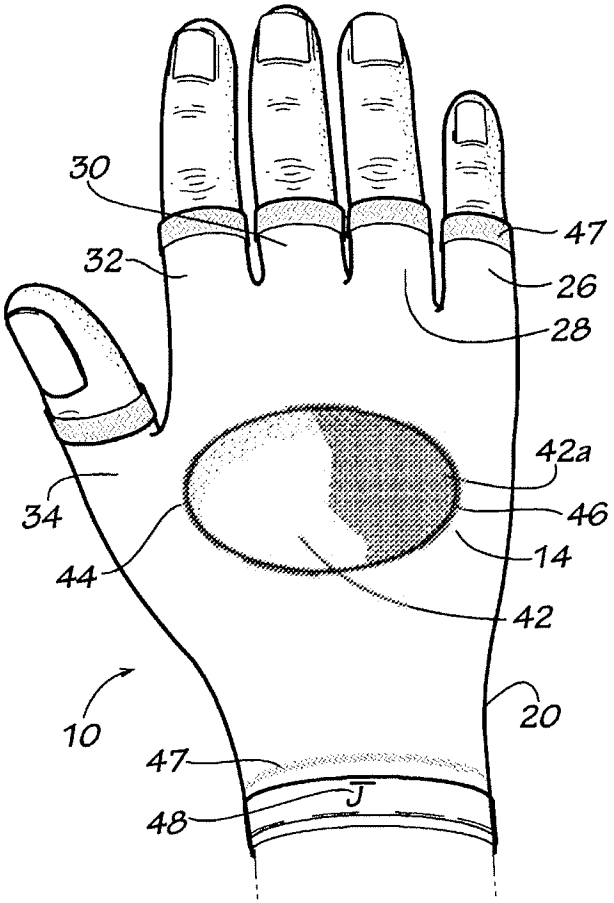
FIG. 3 illustrates a plan view of an opposing back portion of the game glove illustrated in FIG. 1.

FIG. 3 illustrates a plan view of the back portion 14 of the envelope 16 from which the finger tubes 26, 28, 30, 32 and the thumb tube 34 extend. The back portion 14 defines an aperture 42, which is the illustrated embodiment has an elongated oval shape exposing the back of the player's hand. The aperture 42 dominates the area of the back portion 14 and has an opposing thumb apex 44 and little finger apex 46. The thumb apex 44 is proximate a line defined by an outer edge of the finger tube 26 adjacent the thumb tube 34. The little finger apex 46 is intermediate lines defined by the opposing sides of the little finger tube 26. In the illustrative embodiment, the wrist portion 20 optionally displays a symbolic indicia 48.

The aperture 42 may be open or alternatively may be covered with a patch of an elastic stretchable breathable fabric 42*a* (partially illustrated).

The gamer's glove 10 may be made with a hydrophilic cloth or sheet material, that may be form-fitting, stretchable, and breathable, with wicking properties. The material provides for absorption of perspiration from the player's hand within the glove 10 during play of games and operation of game controller devices. The sheet material may include wicking properties for drawing moisture away from the player's hand and into the body of the sheet that forms the game glove 10.

The resilient pad 36 may be a unitary resilient material such as PVC, silicon, rubber, foam, or a fluidal, resilient material held within an envelope attached to the palm portion 14. The resilient pad 36 may attach by adhering material such as glue or adhesive, heat bond, or may have a perimeter flange for stitching or sewing the resilient pad to the palm portion 12. In an alternate embodiment (not illustrated), the palm portion 12 includes a pocket that receives the resilient pad 36.

The game glove 10 of the present invention is used by a game player for holding game controllers during operation or play of games. The player loosens the band 22 and inserts his hand through the wrist portion 18, 20 into the envelope 16. The player pulls or tugs the wrist portions 18, 20 for seating the hand within the envelope 16 and while also extending the player's fingers through the finger tubes 26, 28, 30, 32 and through the thumb tube 34. The player pulls the wrist portion to seat the hand fully within the envelope 16 with the fingers and thumb extending freely beyond the distal ends of the respective tubes. The player threads the band 22 through the loop 24 and then, holding the distal free end of the band, pulls the band laterally to secure the wrist portions 18, 20 about the wrist of the player. The first and second engaging materials 23, 25 on the band 22 contact and detachable engage to hold the band about the wrist of the player. In an alternate embodiment, the band 22 may be elastic or may be a band that defines openings through which a pin extends to fix the band in position.

During operational play of a game, the player wearing the game glove 10 handles the game controller normally. The pad 36 provides a buffering cushion for flexible, pivoting movement of the player's thumb relative to the controller. The optional grip dots 40 cooperate with the pad 36 for holding the game controller. The fingers and thumb of the game player extending through the respective tubes 26, 28, 30, 32 and 34 allows the player to make selected flexible movement of the extended fingers and thumb in operating the game controller.

The covered portions of the hand, fingers and thumb within the envelope and the tubes are in contact with the wicking or absorbent material of the game glove 10. Perspiration moisture and sweat from the hand wicks or absorbs into the sheet material. The glove allows the player to have a more secure grip on the game controller and, thus, facilitates longer and more satisfactory game play. Further, the flexible movement of the fingers and thumb of the player and the arcing of the player's hand during operation of the controller device forms a varying gap in situ between the palm of the player's hand and the palm portion 12 of the glove. The flexing motion of the lands 37 changes the volume of the gap relative to the palm portion 12. This allows air to enter under the envelope 16 and tubes 26, 28, 30, 32 and 34 through the apertures 38, and thereby assist with the cooling the hand or absorbing the perspiration moisture of the hand. The resilient pad 36 may facilitate a bearing point for the game controller. The arching lateral movement of the player's hand allows the palm portion of the envelope to flex back and forth inwardly and outwardly relative to the palm of the player's hand. The lands of the palm portion thereby communicates air through the aperture 38 inwardly and outwardly of the gap between the palm and the palm portion of the glove envelope. In an alternate embodiment, the palm portion 12 is a stretchable breathable woven fabric with interstices as apertures for communicating air.

It is to be appreciated that the glove 10 may include ornamental features. For example, the distal portions of the tubes 26, 28, 30, 32 and 34 may have ornamental or patterned stitching 47 and the wrist portions 18, 20 may likewise have such stitching. The symbolic indicia 48 on the band 22 may be a brand logo, a sports symbol, an image of a character of a video game, or other symbol or image.

Accordingly, the illustrated embodiment of the present invention provides a game glove comprising a hand-receiving envelope with a palm portion and an opposing back portion. A wrist portion extends from a wrist side of the envelope for receiving a gamer's hand through the wrist portion and into the envelope. Four finger tubes extend from the envelope opposing the wrist portion. A thumb portion extends at an oblique angle from a side portion of the envelope. The finger tubes and thumb tube are open-ended, and extend a respective first distance, whereby a respective finger and thumb of the gamer's hand extends therethrough and beyond. The finger tubes and thumb tube cover substantially all of a first segment of the respective fingers and thumb, leaving a respective distal portion free. The palm portion defines a plurality of spaced-apart apertures (centrally disposed in the palm portion, or arcuately-aligned spaced-apart apertures proximate the finger tubes, or in an alternate embodiment, a combination of such apertures.) A resilient pad attaches to the palm portion proximate a lateral portion from which the thumb tube and the immediately adjacent finger tube extends. The pad cushions the action of the of the player's thumb while operating the game controller. The back portion defines an aperture having a dominant space of the back portion. A band attached to a side of the wrist portion extends through a loop on an opposing side whereby the band may be tightened for securing the wrist portion about the wrist of the player. While wearing the glove 10 and during operation of the game controller, air communicates through the apertures 38 for assisting in perspiration absorption. Moisture also wicks from the hand into the material of the glove 10. The material of which the glove 10 is made may allow washing of the glove, such as by hand or by machine, for cleaning.

The glove 10 accordingly provides a covering over the hand for gripping of the game controller yet provides air communication apertures proximate the palm of the game player's hand which apertures defined by lands of the palm portion of the covering that upon operation of the game controller flex to vary the gap between the lands and the plan for cooling and perspiration control, with an embodiment that may have a wicking feature to further assist with cooling and perspiration control, and with an embodiment that may provide the opposing aperture that dominates the back portion 14 of the covering.

The foregoing has disclosed an improved game glove for gamers providing cooling grasp of the game controller during play of games. It should be understood that the above-described embodiments merely illustrate principles and features of the invention. Many modifications, additions, and deletions may, of course, be made thereto without departure from the spirit and scope of the invention as set forth in the following claims.

What is claimed is:

1. A game glove, comprising:

a hand-receiving envelope with a palm portion and an opposing back portion, a wrist portion extends from a wrist side of the envelope for receiving a gamer's hand through the wrist portion and into the envelope, four finger tubes extend from the envelope opposing the wrist portion, and a thumb portion extends at an oblique angle from a side portion of the envelop, the finger tubes and thumb tube are open-ended, and extend a respective first distance, whereby a respective finger and thumb of the gamer's hand for being received therethrough such that the finger tubes and thumb tube cover substantially all of a first segment of the respective fingers and thumb, leaving a respective distal portion free;

the palm portion defines a plurality of arcuately-aligned spaced-apart apertures proximate the finger tubes;

a resilient pad attaches to the palm portion proximate a lateral portion from which the thumb tube and the immediately adjacent finger tube extends, whereby the pad cushions the action of the of the player's thumb while operating the game controller, whereby the glove being worn flexes by movement of the player's hand operating the game controller for communicating air through the apertures for assisting in evaporation of perspiration.

2. The glove as recited in claim 1, wherein the envelope is a wicking material.

3. The glove as recited in claim 1, wherein the envelope is hydrophilic.

4. The glove as recited in claim 1, wherein the apertures in the palm portion are disposed centrally in spaced-apart relation.

5. The glove as recited in claim 1, where in the apertures in the palm portion are spaced-apart apertures disposed intermediate a central point of the palm portion and the finger tubes.

6. The glove as recited in claim 1, further comprising a closing member for securing the wrist portion about the wrist of the player.

7. The glove as recited in claim 5, wherein the closing member comprises a band attached to a side of the wrist portion having opposing mating surfaces and a loop on an opposing side through which the band extends and overlaps whereby the band may be tightened and secured in place by connecting the opposing mating surfaces.

8. The glove as recited in claim 1, wherein a dominant portion of the back portion defines an aperture therein, for facilitating communication of air into the envelope and for permitting perspiration from the back of the hand to be exposed to air.

9. The glove as recited in claim 1, further comprising a plurality of grip dots disposed on the palm portion.

10. A game glove, comprising:

a hand-receiving envelope with a palm portion and an opposing back portion, an open portion on a wrist side of the envelope for receiving a gamer's hand therethrough and into the envelope, four finger tubes extend from the envelope opposing the wrist side, and a thumb portion extends at an oblique angle from a side portion of the envelop, the finger tubes and thumb tube are open-ended, and extend a respective first distance, whereby a respective finger and thumb of the gamer's hand for being received therethrough such that the finger tubes and thumb tube cover a first portion of the respective fingers and thumb, leaving a respective distal portion free outwardly of a distal end thereof;

the palm portion defines a plurality of spaced-apart apertures disposed proximate the finger tubes with surrounding lands;

whereby the glove being worn flexes by movement of the player's hand operating the game controller for communicating air through the aperture for assisting in evaporation of perspiration.

11. The game glove as recited in claim 10, further comprising a resilient pad attached to the palm portion proximate a lateral portion from which the thumb tube and the immediately adjacent finger tube extends, whereby the pad cushions the action of the of the player's thumb while operating the game controller.

12. The game glove as recited in claim 10, wherein the apertures in the palm portion are disposed centrally in spaced-apart relation.

13. The game glove as recited in claim 12, wherein the apertures are disposed on radial lines relative to a central point of the palm portion.

14. The glove as recited in claim 10, wherein the apertures in the palm portion are arcuately-aligned spaced-apart apertures disposed intermediate a central point of the palm portion and the finger tubes.

15. The glove as recited in claim 10, wherein a dominant portion of the back portion defines an aperture therein, for facilitating communication of air into the envelope and for permitting perspiration from the back of the hand to be exposed to air.

16. The glove as recited in claim 10, further comprising:

a wrist portion that extends from a wrist side of the envelope; and a closing member for securing the wrist portion about the wrist of the player upon receiving a gamer's hand therethrough into the envelope.

17. The glove as recited in claim 16, wherein the closing member comprises a band attached to a side of the wrist portion having opposing mating surfaces and a loop on an opposing side through which the band extends and overlaps whereby the band may be tightened and secured in place by connecting the opposing mating surfaces.

18. The glove as recited in claim 10 further comprising a plurality of grip dots disposed on the palm portion.

* * * * *